United States Patent [19]

Chamberlin

[11] 4,379,035

[45] Apr. 5, 1983

[54] METHOD OF OPERATING AN ELECTROLYTIC CELL

[75] Inventor: Ronald D. Chamberlin, Wadsworth, Ohio

[73] Assignee: PPG Industries, Inc., Pittsburgh, Pa.

[21] Appl. No.: 376,328

[22] Filed: May 10, 1982

[51] Int. Cl.[3] ..... C25B 1/16; C25B 1/26

[52] U.S. Cl. ..... 204/98; 204/128

[58] Field of Search ..... 204/98, 128

[56] References Cited

PUBLICATIONS

Wormwell & Mercer, "Sodium Benzoate and Other Metal Benzoates as Corrosion Inhibitors in Water and in Aqueous Solutions," *J. Appl. Chem.*, vol. 2, pp. 150–160, Mar. 1952.

Wormwell & Mercer, "Sodium Benzoate and Sodium Nitrite as Corrosion Inhibitors in Ethylene Glycol Anti--Freeze Solutions, I. Laboratory Investigations," *J. Appl. Chem.*, vol. 3, pp. 22–27, Jan. 1953.

*Primary Examiner*—T. M. Tufariello
*Assistant Examiner*—T. Williams
*Attorney, Agent, or Firm*—Richard M. Goldman

[57] ABSTRACT

Discloses a method of operating a chlor-alkali cell having a low hydrogen overvoltage cathode and exposed high hydrogen overvoltage metal structure within the cathode compartment, where a composition of sodium nitrite and sodium benzoate is added to the catholyte to avoid corrosion of the exposed, high hydrogen overvoltage metal.

6 Claims, No Drawings

METHOD OF OPERATING AN ELECTROLYTIC CELL

Electrolytic cells for the electrolysis of aqueous alkali metal chloride solutions are characterized by an anode, a cathode, and the presence of highly ionized electrolyte. More particularly, diaphragm cells, that is, electrolytic cells where the anodes and anolyte liquor are separated from the cathode and catholyte liquor by an electrolyte permeable barrier, and permionic membrane cells, that is, electrolytic cells where the anode and anolyte compartment are separated from the cathode and catholyte compartment by an electrolyte impermeable but ion permeable barrier, are characterized by strongly acidic anolyte liquors, e.g., having a pH of from about 2.5 to about 5.0, and strongly alkaline catholyte liquors, e.g., having a pH above 14, that is, containing in excess of one mole per liter of ionized alkali metal hydroxide.

The strongly alkaline conditions of the catholyte compartment make the materials of construction used therein, e.g., steel, stainless steel, or the like, subject to galvanic corrosion. Galvanic corrosion is aggravated when low hydrogen evolution overvoltage cathodes are used. Recent developments in chlor-alkali technology have favored the introduction of low overvoltage hydrogen evolution cathode electrocatalysts, exemplified by various active, high surface area nickel cathode electrocatalysts. One particularly desirable cathode electrocatalyst is a porous nickel coating, film, or layer on an electroconductive substrate, for example, an iron or stainless steel substrate. The unprotected areas of the substrate, that is, the areas exposed to electrolyte and adjacent to the porous nickel, and especially those areas at the three phase boundary of porous nickel, substrate, and electrolyte, are highly susceptible to local galvanic corrosion. Moreover, those parts of the electrolytic cell in contact with catholyte liquor and subject to being rendered, even momentarily, anodic, e.g., by electrolyte stagnation or the like, are also highly susceptible to galvanic corrosion.

The galvanic corrosion, whether of the cell body, the electrode substrate, or electrode substrate at the three-phase interface of the substrate, catalyst, and electrolyte, is evidenced by high levels of iron ion in the catholyte liquor product, e.g., ferric ion and ferrous ion combined concentrations in excess of 40 parts per million, anhydrous basis. The presence of high levels of iron in the catholyte liquor is deleterious to certain process in which the caustic soda or caustic potash products are utilized, for example, nylon synthesis. Similarly, the presence of iron in the caustic soda or caustic potash is deleterious to the formation, appearance, and acceptability of solid caustic soda and caustic potash, e.g., flaked or prilled products.

It has now been found that the presence of small amounts of alkali metal benzoate and alkali metal nitrite in the catholyte compartment of the cell, e.g., as additives directly to the catholyte compartment and liquor therein, results in a lowering of the iron content of the product. While not wishing to be bound by this explanation, it is believed that the alkali metal nitrite acts as a local oxidant while the alkali metal benzoate acts as an adsorption inhibitor, adsorbing on a surface and inhibiting corrosion of the surface. Exemplary cathode coatings are porous, or activated nickel coatings, for example as prepared by the deposition of an alloy of nickel and aluminum and chemical removal of the aluminum or by the deposition of the composition of nickel and zinc and subsequent removal of the zinc. The activity of the electrodes is evidenced by the pyrophoric character of the electrodes after activation, that is after removal of the aluminum or zinc, when exposed to air. Most commonly the cathode comprises the active or porous nickel film on an iron or steel substrate. The iron or steel substrate, where exposed to alkaline catholyte liquor, is susceptible to galvanic corrosion.

The electrolytic cells herein contemplated may further be characterized by exposed iron in the structural members thereof, i.e., the body parts, interior lining, and the like. These iron containing areas are subject to galvanic corrosion, especially so with the low hydrogen evolution overvoltage cathodes herein contemplated, and especially at imperfections, defects, inclusions, and stagnant pools of electrolyte.

Moreover, operation of electrolytic cells, especially electrolytic cells having a permionic membrane, and activated, porous nickel cathodes, necessitate practices during shut-down which inherently give rise to conditions which enhance the rate of corrosion of exposed iron surfaces.

According to the method herein contemplated, a composition of an alkali metal benzoate and an alkali metal nitrite are added to the catholyte liquor of the cell, within the catholyte compartment during electrolysis. The alkali metal benzoate and alkali metal nitrite preferably have the same alkali metal cation, most commonly sodium or potassium. The particular alkali metal cation is most commonly the cation of the alkali metal chloride being electrolyzed. The alkali metal nitrite is a local oxidant while the alkali metal benzoate acts as a local oxidation inhibitor, the alkali metal nitrite and alkali metal benzoate acting together to oxidize the exposed iron and thereafter form an inhibiting film thereon.

DETAILED DESCRIPTION OF THE INVENTION

According to the invention herein contemplated, there is provided a method of operating an electrolytic cell for the production of chlorine and aqueous alkali metal hydroxide, e.g., sodium hydroxide or potassium hydroxide. The electrolytic cells useful in the practice of the method herein contemplated has an anolyte compartment with an anode therein and a catholyte compartment with a cathode therein. The cathode is characterized by having a low hydrogen overvoltage surface thereon, while the catholyte compartment is characterized by the presence of exposed iron therein. The low hydrogen overvoltage surface of the cathode has a lower hydrogen overvoltage than the exposed iron thereby giving rise to galvanic corrosion. The prior art comprises feeding alkali metal chloride brine to the anolyte compartment, passing an electrical current from the anode to the cathode, and recovering an aqueous alkali metal hydroxide catholyte containing trace amounts of iron as an impurity, e.g., total iron ion, on an anhydrous basis, being above about 40 parts per million. As herein contemplated, an iron corrosion inhibiting amount of a composition of alkali metal benzoate and alkali metal nitrite is added to the catholyte compartment during electrolysis, whereby to maintain the total iron, anhydrous basis, below about 40 parts per million, and preferably below about 20 parts per million.

As herein contemplated, the cathode is a low hydrogen evolution overvoltage cathode. By a low hydrogen evolution overvoltage cathode is meant that the hydrogen evolution overvoltage at a current density of 200 amperes per square foot is less than 0.1 volt, versus a normal hydrogen reference electrode product, sodium hydroxide, or potassium hydroxide.

The amount of inhibitor, i.e., the benzoate and nitrites added to the catholyte compartment of the cell is believed to be a function of cathode area, catholyte liquor volume, and exposed metal area within the cell. The amount added is an effective amount to maintain the iron content of the catholyte liquor below 40 parts per million, anhydrous basis. Generally the amount of addition expressed as benzoate is from about 0.02 to about 0.2 gram of benzoate per hour per square centimeter of cathode area, from about 0.1 to about 0.5 gram of benzoate per hour per square centimeter of metal area other than the cathode, and from about 0.001 to about 0.1 gram of benzoate per hour per cubic centimeter of catholyte liquor volume within the catholyte compartment.

While the addition is spoken of in terms of benzoate, the nitrite is added substantially simultaneously therewith. Generally the amount of nitrite added is from about 0.05 gram of nitrite per gram of benzoate to about 0.5 gram of nitrite per gram of benzoate, i.e., from 1 part of nitrite per 20 parts of benzoate to 1 part of nitrite per 2 parts of bnezoate. The rates of addition are time average, that is, they are expressed in terms of grams per unit volume per unit time or unit area per unit time. The addition may be continuous, that is as a very dilute composition of the nitrite and benzoate in the water or dilute caustic fed to the catholyte compartment, or as a dilute solution, e.g., a solution of from parts per million to saturation, i.e., about 160 grams per liter, of total benzoate and nitrite in a separate water or caustic stream added to the catholyte compartment. The stream may be added substantially continuously, or intermittently. Moreover, when added intermittently, the composition may be added responsive to an increase in the iron, anhydrous basis in the catholyte liquor product.

The effect of adding the alkali metal benzoate-alkali metal nitrite composition to the catholyte liquor is dependent upon the prior condition of the cathode substrate and catholyte body. That is, where a substantial amount of corrosion and corrosion product are present, only a slight reduction in iron content of the catholyte liquor will be initially observed. However, subsequent additional reductions of iron content may be expected. Alternatively, where the cell is initially operated with alkali metal nitrite-alkali metal benzoate addition to the catholyte compartment, the iron in the catholyte liquor may be as low as 20 parts per million, anhydrous basis.

The following examples are illustrative of the method of this invention.

EXAMPLE I

An aqueous composition of sodium nitrite and sodium benzoate was fed to the catholyte compartment of a chlor-alkali cell while electrolysis was being carried out.

The electrolytic cell had a 5 inch (12.5 cm) by 7 inch (17.5 cm) by 1 inch (2.5 cm) deep anolyte compartment with a ruthenium dioxide-titanium dioxide, titanium mesh anode, and a 5 inch (12.5 cm) by 7 inch (17.5 cm) by 1 inch (2.5 cm) deep catholyte compartment fabricated of chlorinated polyvinyl chloride.

The cathode compartment electrolyte volume was 37.6 cubic inches (617 cubic centimeters). The cathode was a Raney nickel coated mild steel mesh. The anode was separated from the cathode by a slurry deposited, asbestos diaphragm codeposited with Allied Chemical Corp. HALAR® poly(chlorotrifluoroethylene-ethylene) copolymer.

A liquid composition was prepared containing 178.6 grams of sodium benzoate and 17.9 grams of sodium nitrate in 2000 milliliters of water.

A brine feed containing 310 grams per liter of sodium chloride was fed to the anolyte compartment, and electrolysis was commenced at a current density of 200 Amperes per square foot. The sodium benzoate-sodium nitrite solution was added to the catholyte compartment dropwise through a reciprocating pump at a time average rate of 11.38 milliliters per hour, i.e., sodium benzoate was added at a rate of 1.0 gram per hour and sodium nitrite was added at a rate of 0.1 gram per hour. This was a rate of about $2.5\times10^{-3}$ grams of sodium benzoate and $2.5\times10^{-4}$ gram of sodium nitrite per hour per square centimeter of exposed metal other than the cathode, about $1.3\times10^{-3}$ gram of sodium benzoate and $1.3\times10^{-4}$ gram of sodium nitrite per hour per cubic centimeter of catholyte volume, and about $2.5\times10^{-3}$ gram of sodium benzoate and $2.5\times10^{-4}$ gram of sodium nitrite per hour per square centimeter of cathode.

Over a period of 7 days of cell operation with addition of the sodium nitrite-sodium benzoate composition to the catholyte compartment the catholyte liquor overflow contained an average (mean) of 14.3 parts per million iron, anhydrous basis, a median of 13.9 parts per million iron, anhydrous basis, and six of the seven samples being between 5.9 and 24.5 parts per million iron, anhydrous basis.

EXAMPLE II

The method of Example I was repeated except that the sodium nitrite content of the composition was increased to 35.8 grams, and the cell was operated for ten days prior to the commencement of sodium nitrite-sodium benzoate addition.

The following results were obtained:

| Cumulative days of Operation | Iron in catholyte liquor, anhydrous basis |
|---|---|
| 3 | 63.4 |
| 4 | 50.5 |
| 5 | 42.9 |
| 6 | 46.7 |
| 7 | 47.4, 44.3 |
| 10 | 47.9, 44.0 |
| Commenced addition of sodium nitrite-sodium benzoate | |
| 10 | 33.4 |
| 11 | 29.7 |
| 12 | 29.9 |
| 13 | 28.9 |
| 14 | 32.2 |
| 17 | 34.4 |
| 18 | 35.1 |
| 19 | 37.2 |
| 20 | 39.2 |

While the invention has been described with respect to certain preferred exemplifications, embodiments, and illustrative examples, it is to be understood that the invention is not to be limited thereby, and that alternative exemplifications and embodiments are encompassed within the contemplated scope of the invention, the invention being limited solely by the claims appended hereto.

I claim:

1. In a method of operating an electrolytic cell having an anolyte compartment with an anode therein, a catholyte compartment with a cathode therein, wherein the cathode has a low hydrogen overvoltage surface thereon, and the catholyte compartment has exposed iron therein, the low hydrogen overvoltage surface having a lower hydrogen overvoltage than the exposed iron, which method comprises feeding alkali metal chloride brine to the anolyte compartment, passing an electrical current from the anode to the cathode, and recovering an aqueous alkali metal hydroxide catholyte containing iron as an impurity, the improvement comprising adding an iron corrosion inhibiting amount of a composition comprising alkali metal benzoate and alkali metal nitrite to the catholyte compartment during electrolysis.

2. The method of claim 1 wherein the cathode comprises porous nickel.

3. The method of claim 2 wherein the cathode comprises a porous nickel film on an iron substrate.

4. The method of claim 1 comprising feeding the composition at a time average rate of above 0.02 gram of the composition, anhydrous basis, expressed as benzoate, per square centimeter of cathode area per hour.

5. The method of claim 1 comprising feeding the composition at a time average rate of above 0.001 gram, anhydrous basis, expressed as benzoate, of the composition per milliliter of catholyte volume per day.

6. The method of claim 1 wherein the weight ratio of alkali metal nitrite to alkali metal benzoate in the composition is from 0.05 to 1 to 0.5 to 1.

* * * * *